US006883765B2

(12) United States Patent
Lozano et al.

(10) Patent No.: US 6,883,765 B2
(45) Date of Patent: Apr. 26, 2005

(54) BEVERAGE CONTAINER HOLDER

(76) Inventors: Jorge Pablo Lozano, Calle 116 N °1522 Ciudad de la Plata, Buenos Aires (AR); Juan Carlos Alberto Seco, Calle 3 bis N °1220 Ringuelet, Ciudad de la Plata, Buenos Aires (AR)

( * ) Notice: Subject to any disclaimer, the term of this patent is extended or adjusted under 35 U.S.C. 154(b) by 42 days.

(21) Appl. No.: 10/393,377

(22) Filed: Mar. 20, 2003

(65) Prior Publication Data

US 2004/0182978 A1 Sep. 23, 2004

(51) Int. Cl.[7] ..... A47H 1/10

(52) U.S. Cl. ..... 248/300; 248/309.1; 248/311.2; 220/62; 220/738; 220/740; 229/400; 229/904

(58) Field of Search ..... 248/460, 311.2, 248/300, 309.1, 459, 174; 224/62, 62.1, 6, 7, 666, 737, 738, 740, 754, 759, 760, 770, 776, 775, 907; 229/400, 402, 904

(56) References Cited

U.S. PATENT DOCUMENTS

| | | | | | |
|---|---|---|---|---|---|
| 378,610 | A | * | 2/1888 | Murohy | 4/285 |
| 1,443,901 | A | * | 1/1923 | Murray | 220/6 |
| 1,879,837 | A | * | 9/1932 | Bierlich | 126/43 |
| 1,915,958 | A | * | 6/1933 | Skirrow | 248/300 |
| 2,831,647 | A | * | 4/1958 | MacKay | 248/205.3 |
| 2,955,706 | A | * | 10/1960 | Emrick | 206/481 |
| 2,971,654 | A | * | 2/1961 | Whorton | 211/73 |
| 3,128,983 | A | * | 4/1964 | Wood | 248/311.2 |
| 3,128,984 | A | * | 4/1964 | Palm | 248/311.2 |
| 3,184,046 | A | * | 5/1965 | Berg | 206/780 |
| D247,868 | S | * | 5/1978 | Britt | D7/700 |
| 4,424,906 | A | * | 1/1984 | Richmond | 211/50 |
| 4,775,093 | A | * | 10/1988 | Lin | 229/117.25 |
| 4,778,055 | A | * | 10/1988 | Kiedaisch | 206/563 |
| 4,893,773 | A | * | 1/1990 | Fujimoto | 248/311.2 |
| 4,895,259 | A | * | 1/1990 | Paley | 206/565 |
| 4,979,657 | A | * | 12/1990 | Espiritu | 224/549 |
| 5,301,871 | A | * | 4/1994 | Gross et al. | 206/562 |
| 5,755,376 | A | * | 5/1998 | Greer et al. | 229/107 |
| 6,371,428 | B1 | * | 4/2002 | Zorich et al. | 248/311.2 |
| 6,540,133 | B1 | * | 4/2003 | Chou | 229/117.22 |
| 2003/0071045 | A1 | * | 4/2003 | Taylor | 220/737 |

FOREIGN PATENT DOCUMENTS

| | | | |
|---|---|---|---|
| FR | 2699150 A1 | * | 6/1994 |
| GB | 2260968 A | * | 5/1993 |

* cited by examiner

*Primary Examiner*—Anita King
*Assistant Examiner*—Naschica S. Morrison
(74) *Attorney, Agent, or Firm*—Martin Fleit; Paul D. Bianco; Fleit Kain Gibbons Gutman Bongini & Bianco P.L.

(57) ABSTRACT

A novel holder in the form of a structural volume for holding a container and a flexible strap coupled to the structural volume. The structural volume is made form a disposable unitary blank composed of a biodegradable material and having a central base with legs extending therefrom to form a cruciform shape. Fold lines are provided between the base and the legs that enable the blank to be folded into a prism to form the structural volume. A ring is attached to one of the legs remote from the base and has a tab for coupling with the opposite leg to complete the structural volume. A container can be carried in the structural volume and be supported on the base.

5 Claims, 3 Drawing Sheets

BEVERAGE CONTAINER HOLDER

BACKGROUND OF THE INVENTION

1. Field of the Invention

The present invention relates to a beverage container holder, particularly for display of commercial presentations or advertising.

2. Prior Art

One can find in the market pieces molded in cardboard or poster board, used mainly in fast-food places for special promotions in children's menus, such as, the so-called "happy box" or "magic box". Also, in such places, various containers are used for various foods being sold, such as, French fries. No disposable products are known in the market, made of folded sheets, that can be used as containers and that are portable, lightweight and safe. There are indeed volumetric plastic products in the market, made by injection or inflation, but these products do not serve or satisfy the needs of the present invention.

SUMMARY OF THE INVENTION

This present invention provides a beverage container holder that can be used for display of commercial presentation of juices, sodas and other beverages, be it in cups, aluminum cans or any other type of container used for this purpose. It is formed starting from a die-stamped sheet of paper or cardboard subjected to a series of folding operations that generate the novel holder.

This product of the present invention is intended to be used in fast food places, as well as, in commercial promotions of beverages, utilizing its principal components: the container holder base and a strap or ribbon by means of which the user can carry the novel holder on his or her chest.

The main objective of the present invention is to facilitate the carrying of cups or aluminum cans that contain beverages, without having to use one's hands, so that in certain situations, one can perform simultaneous tasks while enjoying the beverage.

Presently, there are several situations in which a complementary means for carrying a beverage would be useful. Just to name a few examples, let's say that this frequently occurs when a person is driving an automobile and has to use his or her hands to pour or serve a drink, thus limiting his or her ability to drive and putting his or her live, as well as the ones of the other passengers, in danger. Another example is in fast-food places with drive-thru facilities where one can obtain food and drinks from the car, and where children and adults try to enjoy their meal without the benefit of a stable surface.

Insofar as the utilization of the novel container holder as a promotional means, the different applications and promotional aids that can be developed are innumerable. The promotion of a new movie for children with the characters incorporated into the design of the base, coupons for exchange, slogans and special food promotions (menus) are some of the possibilities that could be mentioned, as examples.

Advantages of the present invention include storing, in its initial sheet form (unassembled), the knock-down blanks from which the novel holder of the present invention is assembled. Thus, if the storing occurs in a commercial place, space is conserved. The blanks also facilitate transportation of the novel holder. Also, the knock-down character of the novel holder of the present invention facilitates its destruction after its use and the preservation of the environment, since the novel holder is totally disposable and biodegradable.

This product of the invention is shaped on the basis of a minimum basic development that guarantees the necessary structural conditions for holding the drink (container) when hanging from the neck of a person. In this manner, the present invention offers the versatility of adaptation and complement to any applied graphics, either by means of an example of an existing promotion or by the transmission of the desired graphic design. Because of this, the container holder base possesses a starting design on which the desired graphics can be applied.

The geometry of the present invention is a strong contributing factor to its utility and sturdy structural character. The blank constitutes a flat surface similar to that corresponding to a cube (prism), generated with its six sides forming a cross. The beverage container rests on the center surface, this surface being the main plane and having a rectangular or square shape. The four sides project from each of the sides of the main plane, thus forming the cross. The height of these four sides is in direct proportion with the height of the beverage container.

All four sides are folded upwards so as to secure the beverage container. That is, they are folded in such way as to constitute the side boundaries of a volume and, therefore, the cover of this volume is linked to the development of the plane of one of the said four sides.

The cover is folded on a 360° angle, to join with the side opposite to the one to which is attached by the design, thus closing or limiting the six basic sides that make up the closed volume. Finally, the upper plane has a circular cutout or orifice destined to hold and secure the beverage container and to insure its stay within the volume bounded by the holder base. Lastly, the ends of a flexible strap or ribbon, that allow a person a carrying the container to hang it from his/her neck, are attached to the side planes.

The operating principle of a basic model, based on the structural studies carried out to guarantee that a beverage cup or can may be supported without breakage, responds to the fold lines generated for the sheet of paper or cardboard, always in the sense of the surface on which the graphs reside. It must be pointed out that the graphics are to be applied only to the visible side of the sheet. This way, the drink container can be placed in the circular cavity of the base after the sheet has been folded and its ends secured. Finally, the ends of the strap or ribbon (that are formed in such way as to guarantee a secure attachment) are inserted in slits on the sides provided for that purpose.

Therefore, the present invention consists of two laminar components, stamped or cut-out, in dependence of one another and which have been developed in such way so as to obtain the best results: the container holder base, stamped and folded, and the stamped strap or ribbon. It is important to mention that the linkage between the two components is done exclusively by means of their shapes, without the need of adhesives or fasteners.

The basic model developed envisions proportional variations in the die to allow the adaptation of the shape of the product to new container dimensions while maintaining the minimum structural characteristics to guarantee, that either in paper or cardboard, it will not collapse and end up breaking up.

All these factors that determine the product stability during its use, such as the folds, the circular element or ring that secures the container and the anchoring slits that allow the fastening of the ends of the base sides and the carrying strap are the necessary conditions for the shaping of the product:

Condition 1): the product is totally contained in a laminar development on paper, poster board or cardboard and its dimensions correspond to a sheet contained within a standard commercial size A3, that is, 297 mm×420 mm.

Condition 2): the stamped pieces can be stored in sheet form until the time for their use. At this time, it must be folded in accordance with the fold lines stamped on the surface.

Condition 3): the folds in the design guarantee its stability and give structural strength to the system, once it is subjected to the traction due to the weight of the beverage.

Condition 4): the linkages between the product parts are limited only to fastenings by virtue of the shapes and cuts made by die stamping. These, given the properties of the material used (paper, poster board or cardboard) allow the modification of its shape, as well as, the return to its original form. Its shape is thought out with the aim of guaranteeing the adequate performance of its function.

Condition 5): its production, based on recyclable and biodegradable materials (paper, poster board or cardboard) allows the discard of the product after its use. The weight (of the material) to be used is at least 110 gm.

Condition 6): The product must be stable and safe.

The foregoing is accomplished by the present invention by providing a novel holder comprising a structural volume for holding a container and a flexible strap coupled to the structural volume wherein the structural volume is comprised of a disposable unitary blank composed of a biodegradable material and comprised of a base with legs extending therefrom to form a cruciform shape that is provided with fold lines between the base and the legs that enable the blank to be folded into the structural volume. A ring is attached to the free end of one of the legs and has a tab for coupling with the opposite leg to complete the structural volume whereby a container can be carried in the structural volume and be supported on the base.

In addition, the novel holder according to the above is provided with a strap coupled at its ends to opposite sides of the structural volume. The ends of the strap define a reduced section to facilitate coupling to the structural volume. One pair of opposite legs is provided with slits to receive the ends of a strap.

The novel holder according to the above is provided with reinforcing gussets for reinforcing adjacent legs and the base. Also, the pair of opposite legs with the slits also define cutouts adjacent their free ends for providing tabs for cooperation with and for securing the ring.

The structural volume of the novel holder is in the geometrical form of a prism.

Other and further advantages and objects of the present invention will become more evident from the following detailed description of a preferred embodiment when taken with the appended drawings.

DETAILED DESCRIPTION OF PREFERRED EMBODIMENT

Figure 1:
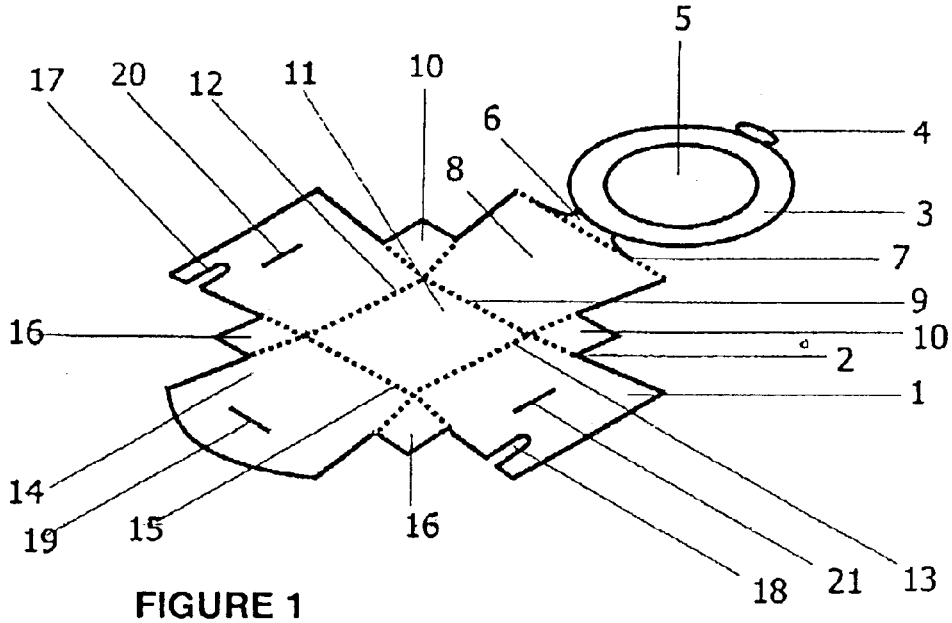
FIG. 1 is a plan view of the blank from which the novel holder of the present invention is formed.

Referring now to the drawings, a preferred embodiment of the present invention, in the form of a novel holder, will be described in detail. In FIG. 1, a blank, in cruciform shape, is shown, completely knocked-down. The laminar development of the stamped surface 1 of the blank includes dotted lines that represent the folds 2 that generate the six sides of the holder volume. An upper ring 3, with its tab for attachment 4, circular orifice 5, neck or hinge 6 and the fold 7 connects it to the back side 8. The latter is connected to the central surface 11 by means of the fold 9 and the angular reinforcements or gussets 10. The central surface 11 constitutes the holder base and is delimited by the left side and fold 12 that allows it to grow towards the left and by the right side and fold 13 that allows it to grow towards the right. Also, one can see the front side 14, linked with the central surface 11 and to the sides 12 and 13 by fold 15 and the angular reinforcements or gussets 16. The slits 17 and 18, located on each of the sides 12 and 13 will secure the container laterally, by virtue of their shape. Finally, one can see the slit 19 that allows the fastening of the end 4 of the upper ring 3, so as to close the volume. One can also see the slits 20 and 21 on the sides 12 and 13.

Figure 2:
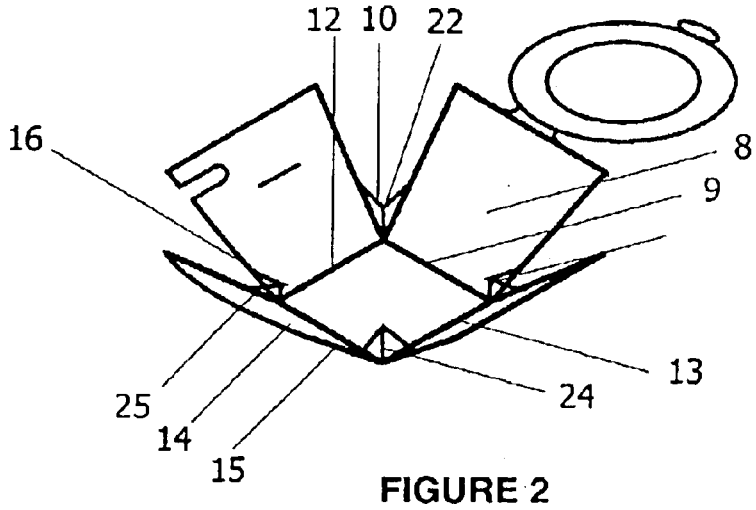
FIG. 2 shows the first step in assembling the blank.

FIG. 2 shows a perspective of the container holder base with its sides folded along the fold lines 12 and 13 as well as its front 14 and back 15 sides folded along lines 8 and 9, respectively. Their corresponding angular reinforcements 16 are folded along the lines 22, 23, 24 and 25.

Figure 3:
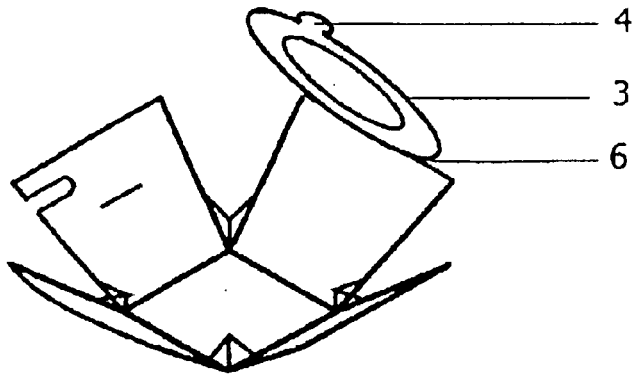
FIG. 3 shows the second step in assembling the blank.

FIG. 3 shows a view in perspective of the container holder base that, unlike the previous figure, has the upper ring 3 folded and ready for attachment by means of its tab 4 and the fold on its neck 6.

Figure 4:
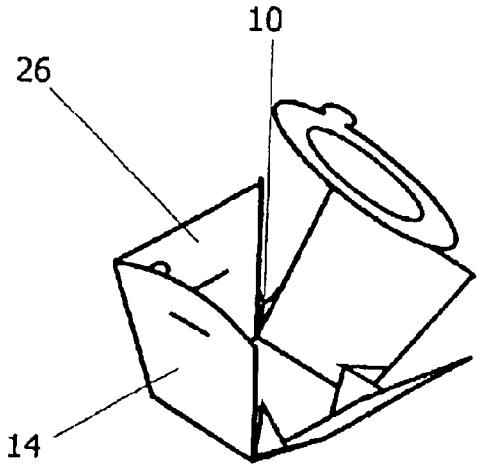
FIG. 4 shows the third step in assembling the blank.

FIG. 4 shows a view in perspective of the container with its side 26 and front 14 completely folded. There one can also see how the angular reinforcements 10 are also completely folded.

Figure 5:
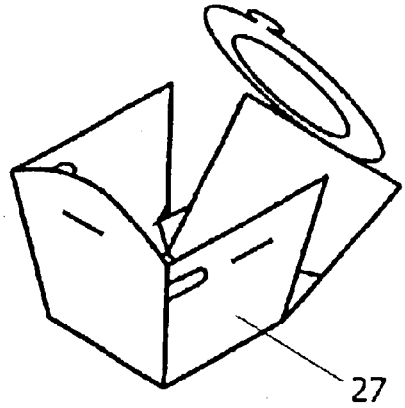
FIG. 5 shows the fourth step in assembling the blank.

FIG. 5 continues with the same view in perspective but with the other side 27 completely folded as well.

Figure 6:
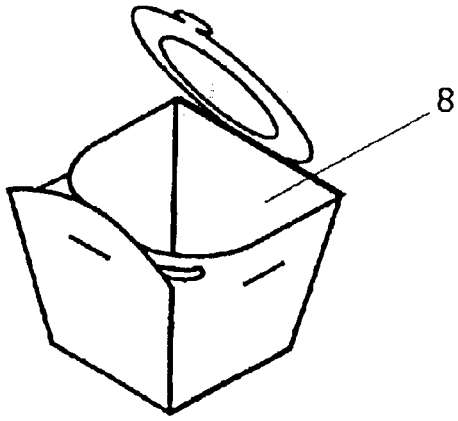
FIG. 6 shows the fifth step in assembling the blank.

In FIG. 6, one can see a view in perspective of the container with its back 8 also completely folded, forming the open prism that will hold the cup or can with the drink.

Figure 7:
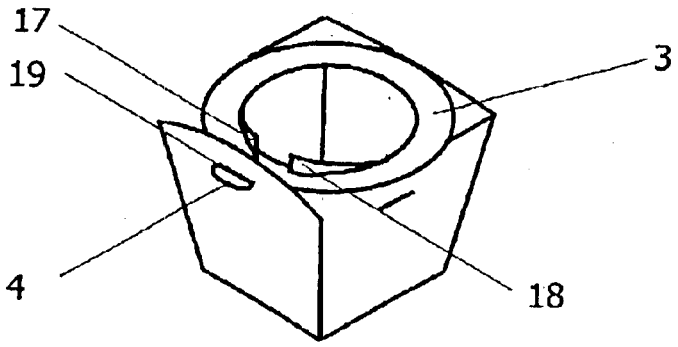
FIG. 7 shows the sixth step in assembling the blank.

Finally, in FIG. 7 the container holder base is shown completely closed, with all its sides folded. One can see that the upper ring 3 holds the tabs 17 and 18 formed by the slits in the left and right sides, thus providing a secure fastening of the same. One can also see that the ring tab 4 is lodged in the slit 19 via the enlarged head of the tab 4.

Figure 8:
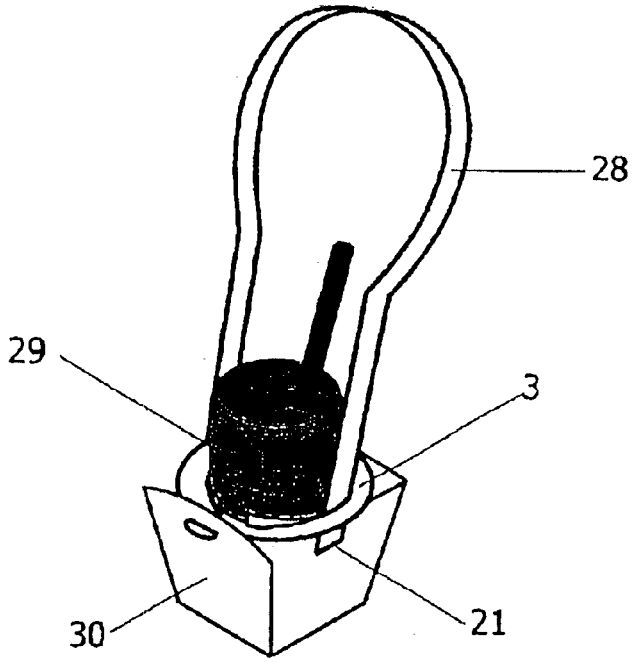
FIG. 8 shows the assembled novel holder with the strap assembled to the base holder, and shows a container inserted into the novel holder.

FIG. 8 shows the container holder base product with its carrying strap or ribbon 28, run through the inside of the upper ring 3 and inserted in the side slit 21. This allows the user to carry the product hanging from his or her neck. As an example, one can also see that the beverage container can be a can 29 lodged in the volume 30.

Figure 9:
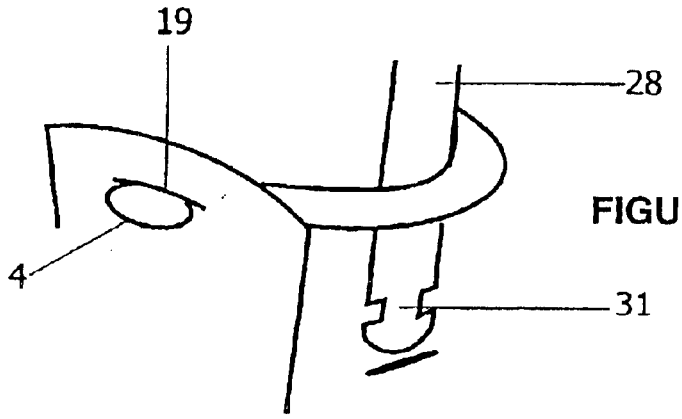
FIG. 9 shows the detail of assembling the strap to the novel holder.

FIG. 9 shows the shape of the end 31 of the strap 28 as well as another view of the upper ring tab 4 inserted in the slit 19. The end 31 is provided with a reduced section to define an end tongue that fits through the slit 21 with the reduced section trapping the end of the strap in slit 21.

Although the invention has been described in terms of a preferred embodiment, it will be appreciated that changes and modifications will be apparent to those skilled in the art from a knowledge of the teachings herein. Such changes and modifications are deemed to fall within the purview of the invention as set forth in the claims herein.

What is claimed is:

1. A novel holder comprising:

a) a structural volume for holding a container;

b) the structural volume is comprised of a disposable unitary blank composed of a biodegradable material;

c) said blank comprising a base with four legs extending therefrom to form a cruciform shape and provided with fold lines between the base and the legs that enable the blank to be folded into the structural volume;

d) said legs being comprised of first pair of opposed legs and a second pair of opposed legs, all of said legs having a free end;

e) an annulus defining a central opening and having an outer periphery, said annulus being hinged at its outer periphery to the free end of one leg of the first pair of legs, and having on its periphery opposite the hinge a first element of a coupling;

f) the other leg of said first pair of legs defining at its free end a second element of said coupling that cooperates with the first element of the coupling to interconnect the first pair of opposite legs via the annulus to define the structural volume;

g) said second pair of opposite legs each defining a horizontal slot extending from an edge remote from the one leg of the first pair of legs having the annulus hinged thereto;

h) gussets formed at the junction of each leg and the base;

i) whereby the structural volume is completed by folding all legs into a vertical position relative to the base, reinforced by the gussets, and bending the second pair of legs behind the other leg of the first pair of legs opposite the one leg having the annulus mounted thereon, and hinging the annulus over the top of the structural volume and interconnecting the annulus with the other leg of the first pair of legs opposite the one leg having the annulus mounted thereon via the first and second elements of the coupling;

j) and whereby the annulus, when coupled to the other leg of the first pair of legs opposite the one leg having the annulus mounted thereon, is received in the horizontal slots defined in the edges of the second pair of legs completing the structural volume and enabling a container to be inserted through the annulus and to be carried securely in the structural volume while being supported on the base.

2. The novel holder according to claim 1 wherein each of the second pair of opposite legs is provided with one element of a second coupling, and a U-shaped strap is provided with first and second free strap ends each defining a second element of said second coupling, said U-shaped strap is looped over the structural volume with the first and second free ends passing through the central opening of the annulus and to the outside of the second pair of opposite legs, and a second coupling is effected for each of the second pair of opposite legs via the first and second elements of the second coupling.

3. The novel holder according to claim 1 wherein the structural volume is in the geometrical form of a prism.

4. The novel holder according to claim 1 wherein the disposable unitary blank is composed of one of paper, poster board and cardboard.

5. The novel holder according to claim 1 wherein the other leg of the first pair of opposite legs is longer than the one leg of the first pair of opposite legs.

* * * * *